US011203951B2

(12) United States Patent
Zhu et al.

(10) Patent No.: US 11,203,951 B2
(45) Date of Patent: Dec. 21, 2021

(54) AIR ENERGY POWER MACHINE

(71) Applicant: Lin Zhu, Shangqiu (CN)

(72) Inventors: Lin Zhu, Shangqiu (CN); Ziqi Zhu, Shangqiu (CN)

( * ) Notice: Subject to any disclaimer, the term of this patent is extended or adjusted under 35 U.S.C. 154(b) by 0 days.

(21) Appl. No.: 17/074,583

(22) Filed: Oct. 19, 2020

(65) Prior Publication Data

US 2021/0047943 A1 Feb. 18, 2021

Related U.S. Application Data

(63) Continuation of application No. PCT/CN2019/081936, filed on Apr. 9, 2019.

(51) Int. Cl.
*F01K 7/16* (2006.01)

(52) U.S. Cl.
CPC ..... *F01K 7/16* (2013.01)

(58) Field of Classification Search
CPC . F01K 7/16; F01K 25/10; F01K 23/04; F22B 1/1838; F04B 39/06; F04B 41/02
USPC ..... 60/655, 659
See application file for complete search history.

(56) References Cited

U.S. PATENT DOCUMENTS 4,400,947 A * 8/1983 Ruhemann ..... F01K 25/10 60/648
4,590,538 A * 5/1986 Cray, Jr. ..... H05K 7/20236 361/700
8,707,701 B2 * 4/2014 Burkhart ..... F02C 7/143 60/655
9,038,390 B1 * 5/2015 Kreuger ..... F03G 6/065 60/655
9,347,437 B2 5/2016 Liu
2008/0157528 A1 7/2008 Ying Wang
2017/0058701 A1 3/2017 Guo

FOREIGN PATENT DOCUMENTS

CN 101550842 A 10/2009
CN 102191952 A 9/2011
CN 102367747 A 3/2012
CN 105317484 A 2/2016
CN 107702432 A 2/2018
CN 108301885 A 7/2018

OTHER PUBLICATIONS

Internation Search Report of PCT/CN2019/081936, dated Jul. 15, 2019.

* cited by examiner

*Primary Examiner* — Hoang M Nguyen

(57) ABSTRACT

An air energy power machine comprises an air compressor (1). An air inlet end of the air compressor is connected with an air storage tank (2) through a pipeline; an air outlet end of the air compressor is connected with a first heat exchanger (3) through a pipeline; a second heat exchanger (4) is connected to the right side of the first heat exchanger through a pipeline; the second heat exchanger is connected with the air storage tank to form a closed loop; a first liquid pump (5) connected with the first heat exchanger through a pipeline is arranged below the first heat exchanger; a first liquid collection tank (6) is connected to the first liquid pump; a first steam turbine (7) is arranged above the first heat exchanger; a steam inlet of the first steam turbine is connected with the first heat exchanger through a pipeline.

4 Claims, 1 Drawing Sheet

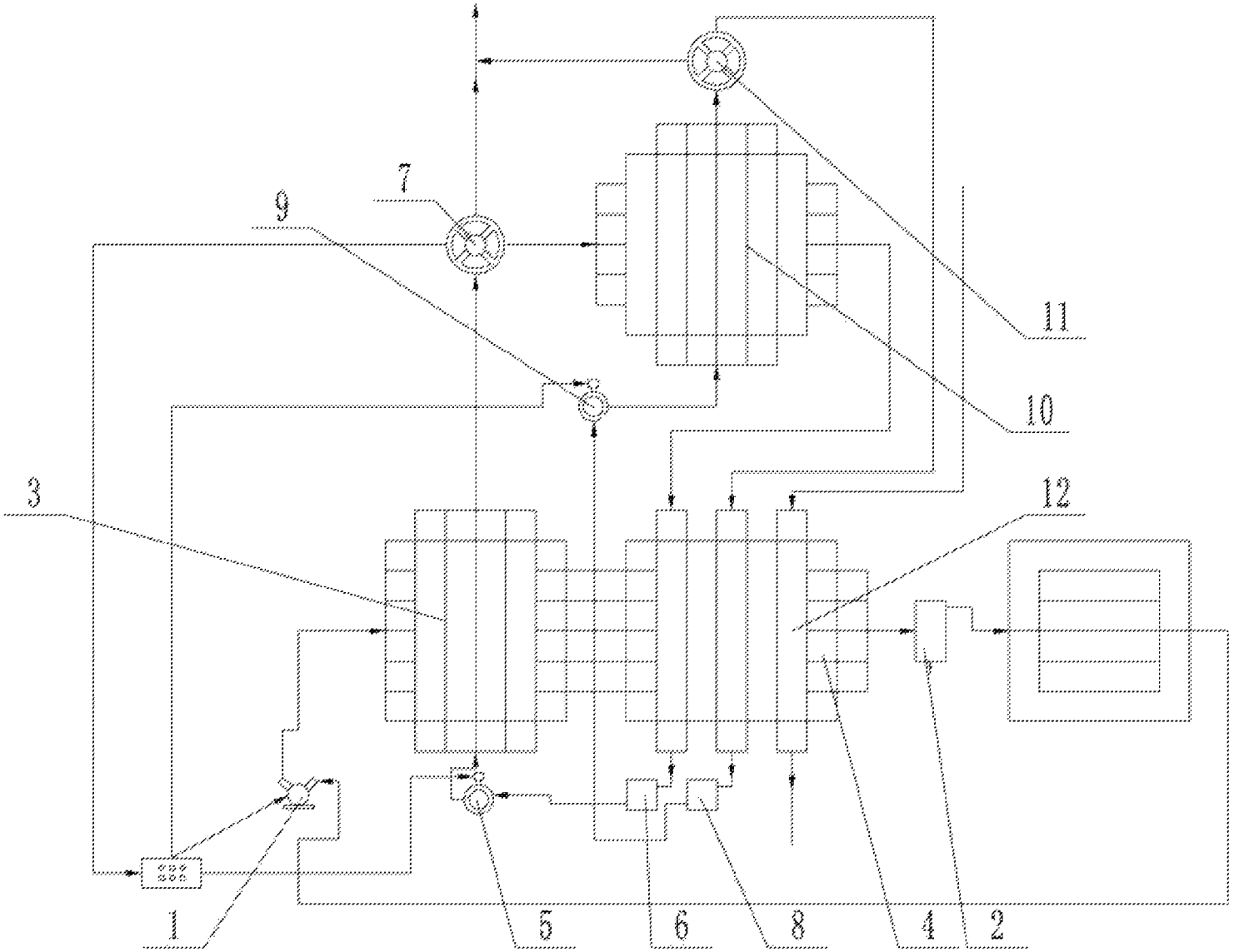
1
2
3
4
5
6
7
8
9
10
11
12

AIR ENERGY POWER MACHINE

CROSS-REFERENCE TO RELATED APPLICATIONS

This application is a continuation of International Patent Application No. PCT/CN2019/081936 with a filing date of Apr. 9, 2019, designating the United States, now pending, and further claims priority to Chinese Patent Application No. 201810358389.5 with a filing date of Apr. 20, 2018. The content of the aforementioned applications, including any intervening amendments thereto, are incorporated herein by reference.

TECHNICAL FIELD

The present invention relates to the field of air thermal power, in particular to an air energy power machine.

BACKGROUND OF THE PRESENT INVENTION

The frequently-used ways to provide power and energy at present include internal combustion engines, boilers, hydropower generation, coal-fired power generation, wind power generation and photovoltaic power generation. The internal combustion engines have strong power, convenient use, long duration and wide range of use, but the internal combustion engines must consume the non-renewable energy oil during use. The use of oil will greatly reduce the underground reserves of oil and pollute the environment; and the massive use of oil will cause the competition in oil resources, trigger a war and endanger human beings. The boilers generally consume coals during use; the use of coals will more seriously pollute the environment and consume more non-renewable energies than the use of oil; and the bulk mining of coals is easy to cause mine disasters and endanger human beings. The coal-fired power generation also consumes coals during use, thereby more seriously polluting the environment and consuming more non-renewable energies. The hydropower generation does not consume the non-renewable energy and pollute the environment, but the construction period of power stations is long; and more raw materials are needed. The construction of hydropower stations is easy to destroy the original ecology and cause earthquakes. The wind power generation and the photovoltaic power generation do not damage the environment and consume conventional resources, but the resources are unstable and highly volatile. For the State Grid, wind electricity and photovoltaic electricity are not high-quality electricity but garbage electricity.

Therefore, the present invention provides an air energy power machine to solve the above problems.

SUMMARY OF PRESENT INTENTION

In view of the above situations, to overcome the defects of the prior art, the present invention provides an air energy power machine to effectively solve the problem that a power generation device is not clean enough.

Solution to the Problem

Technical Solution

The technical solution for solving the problem comprises an air compressor, wherein an air inlet end of the air compressor is connected with an air storage tank through a pipeline; an air outlet end of the air compressor is connected with a first heat exchanger through a pipeline; a second heat exchanger is connected to the right side of the first heat exchanger through a pipeline; and the second heat exchanger is connected with the air storage tank 2 to form a closed loop.

A first liquid pump connected with the first heat exchanger through a pipeline is arranged below the first heat exchanger; a first liquid collection tank is connected to the first liquid pump; a first steam turbine is arranged above the first heat exchanger; a steam inlet of the first steam turbine is connected with the first heat exchanger through a pipeline; a steam outlet of the first steam turbine is connected with the second heat exchanger through a pipeline; and the second heat exchanger is connected with the first liquid collection tank through a pipeline to form a closed loop.

BENEFICIAL EFFECTS OF PRESENT INVENTION

Beneficial Effects

The present invention has novel concept, ingenious structure and strong practicality, and utilizes the energy by that the work applied to the increase of air temperature is greater than the work applied to the consumption of power through air compression so that the energy utilization is cleaner.

BRIEF DESCRIPTION OF THE DRAWINGS

Description of the Drawings

FIG. 1 is a structural schematic diagram of the present invention.

OPTIMAL EMBODIMENT FOR IMPLEMENTING THE INVENTION

Optimal Embodiment of the Invention

Specific embodiments of the present invention will be further described in detail below with reference to the accompanying drawings.

As shown in FIG. 1, the present invention includes an air compressor 1. An air inlet end of the air compressor 1 is connected with an air storage tank 2 through a pipeline; an air outlet end of the air compressor 1 is connected with a first heat exchanger 3 through a pipeline; a second heat exchanger 4 is connected to the right side of the first heat exchanger 3 through a pipeline; and the second heat exchanger 4 is connected with the air storage tank 2 to form a closed loop.

A first liquid pump 5 connected with the first heat exchanger 3 through a pipeline is arranged below the first heat exchanger 3; a first liquid collection tank 6 is connected to the first liquid pump 5; a first steam turbine 7 is arranged above the first heat exchanger 3; a steam inlet of the first steam turbine 7 is connected with the first heat exchanger 3 through a pipeline; a steam outlet of the first steam turbine 7 is connected with the second heat exchanger 4 through a pipeline; and the second heat exchanger 4 is connected with the first liquid collection tank 6 through a pipeline to form a closed loop.

To realize the conversion of more energies, a second liquid collection tank 8 is arranged below the second heat exchanger 4; a second liquid pump 9 is connected to the second liquid collection tank 8 through a pipeline; a third heat exchanger 10 is connected to the second liquid pump 9; a second steam turbine 11 is arranged above the third heat exchanger 10; a steam inlet of the second steam turbine 11 is connected with a third heat exchanger 10; the steam inlet of the second steam turbine 11 is connected with the second heat exchanger 4; and the second heat exchanger 4 is connected with the second liquid collection tank 8 through a pipeline to form a closed loop. Another set of closed loops can be arranged on the second heat exchanger 4 to utilize liquids with different boiling points, thereby achieving higher energy conversion effect.

To achieve better waste heat collection effect, the steam outlet of the first steam turbine 7 is connected with the third heat exchanger 10 through the pipeline; the third heat exchanger 10 is connected with the second heat exchanger 4 through the pipeline; and the second heat exchanger 4 is connected with the first liquid collection tank 6. The waste heat of gas with high boiling point in the first steam turbine 7 can be reused by connecting a steam outlet end of the first steam turbine 7 with the third heat exchanger 10.

To realize the heat exchange between the second heat exchanger 4 and liquids with different boiling points, a plurality of mutually unconnected standpipes 12 are arranged in the second heat exchanger 4; and different standpipes are connected with the liquids with different boiling points to realize the mutual influence of the liquids with different boiling points in the process of heat exchange.

To realize less energy consumption, a sunlight greenhouse or heat absorption sheet is arranged between the air storage tank 2 and the air compressor 1; and the air in the air storage tank 2 is naturally heated by the sunlight greenhouse, thereby reducing the consumed electric energy during air compression.

A specific working process of the present invention is as follows: the air compressor 1 compresses the air, and then the compressed air enters the first heat exchanger 3 through the pipeline; the temperature of the compressed air rises in the first heat exchanger 3; usable low-boiling-point liquid such as vinegar, dichloromethane, tert-butyl bromoacetate or methanol, which has a boiling point of 35-65° C. under normal pressure, is pressed into the first heat exchanger 3 by the first liquid pump 5 at one end of a heat dissipation system of the first heat exchanger 3; the temperature of the low-boiling-point medium rises through heating by the first heat exchanger 3 to increase the pressure; the medium enters the first steam turbine 7 through the pipeline after being heated to increase the pressure; and the power is generated by applying external work or mechanical work through the first steam turbine 7. Since the air compressor 1 provides 3-5 parts of energy when consuming 1 part of energy, the hotter the weather is, the more the energy provided is; and the energy provided is the highest in summer and is the lowest below 10° C. in winter. When the temperature is relatively low in winter, the liquid medium with lower boiling point can be used to conduct heat accordingly because the temperature differences at the inlet of the first heat exchanger 3 and the outlet of the second heat exchanger 4 are the same regardless of the outdoor temperature when the first heat exchanger 3 and the second heat exchanger 4 work. The air from the second heat exchanger 4 enters the air storage tank 2. To provide more energy, the air passing through the air storage tank 2 to the heat absorption sheet can be heated by underground water or seawater in winter, or the heat absorption sheet can be put into the sunlight greenhouse to better absorb energy. The searched data show that the output rate of the steam turbine is 40%-70%, so that the steam turbine can apply external work to generate 1.2-3.5 parts of energy when the air compressor 1 consumes 1 part of energy. At the beginning of start-up, an external power battery or external power is used to supply 1 part of energy to the air compressor 1. After normal operation, 1 part of energy in the first steam turbine can be conveyed to the air compressor 1 by power generation. The first liquid pump 5 and the second liquid pump 9 can supply electricity or directly supply power through a connecting shaft. The circuit switching technology is utilized to turn off the external power and switch into steam turbine power, so that the first steam turbine 7 can provide net 0.2-2.5 parts of energy for external work or power generation. The energy consumed by the first liquid pump 5 and the second liquid pump 9 is negligible. When the temperature of air rises in the first heat exchanger 3, the temperature is greatly reduced after the heat is absorbed by the low temperature medium to apply work; and the cooled air enters the second heat exchanger 4 through the pipeline. The air at the tail end of the second heat exchanger 4 is discharged or decompressed through a closed pipe, first enters the air storage tank 2, and then enters the air compressor 1 after the heat is absorbed by the heat absorption sheet and the temperature rises, or the heat absorption sheet can be put into the sunlight greenhouse; or, the air at the tail end of the second heat exchanger 4 is directly discharged, while the external air is directly pressed in by the air compressor 1 to provide energy. The temperature of the air in the second heat exchanger 4 drops due to the energy absorption in the first heat exchanger 3; the temperature drops rapidly after the air enters the second heat exchanger 4 due to rapid pressure reduction and heat absorption at the tail end. The low-boiling-point medium from the first steam turbine 7 is partially liquefied after applying work, then enters the second heat exchanger 4 through the pipeline, and enters a first liquid collection tank 6 of the low-boiling-point medium after the temperature drops due to heat absorption by the low-temperature second heat exchanger 4 and then the medium is completely liquefied. Then, the first liquid collection tank 6 of the low-boiling-point medium is connected with the first liquid pump 5 through the pipeline; the medium enters the first heat exchanger 3 through the first liquid pump 5 and then is heated to apply work by the first steam turbine 7. The cycle is repeated. The second heat exchanger 4 can also be designed to perform three-path or multi-path heat exchange, i.e., two or more media can exchange heat with low-temperature air without communication, or are connected with another pipeline through the second heat exchanger 4 so that hot air enters and cold air comes out to provide cold air for the outside or for a central air conditioner or a refrigerator in summer. When the weather is particularly cold and the effect is poor in winter, the air after the second heat exchanger 4 can enter heating sheets through the air storage tank; the heating sheets can be sprayed and heated by groundwater and seawater or heated by the sunlight greenhouse for recycling; and then, the heated air enters the air compressor 1 through the pipeline and is pressed into the first heat exchanger 3.

In order for the compressor to provide more energy and the low-boiling-point medium to convert more energy through the steam turbine and apply more work to improve the conversion rate, the following solution can be adopted:

1. The compressors are all made into water-cooled compressors, wherein the low-boiling-point medium is used to cool the compressors while the medium absorbs energy; due to large heat dissipation of the compressors, the pipeline for connecting the air compressor 1 with the first heat exchanger 3 is made into double-layer casing, which is fed with the compressed air in the interior and the low-boiling-point medium at the middle; because the connecting pipeline needs to dissipate heat, the compressors and the double-layer casing are insulated to prevent a small amount of heat from dissipating outwards, so that more energy can be provided; and specifically, the liquid with low boiling point enters a circulating water path of the compressor and then enters the first heat exchanger 3 after coming out to enter the middle of the connecting pipeline, rather than that the liquid with low boiling point directly enters the first heat exchanger 3 from the first liquid pump 5. In this way, the energy provided by the compressor can be greatly increased. 2. The steam turbine is made into two-stage or multi-stage steam turbine to improve the energy conversion rate. It is also possible to use a medium with the boiling point lower than that of the first path of low-boiling-point medium to perform the second path of cooling and energy conversion, e.g., a third heat exchanger 10 is provided; the low-boiling-point medium with the boiling point lower than that of the second path of low-boiling-point medium after applying work by the steam turbine applies work by the second steam turbine 11 after the heat is absorbed; then, the second path of low-boiling-point medium is liquefied after the heat is absorbed by the second heat exchanger 4, enters the second liquid storage tank 8 of the low-boiling-point medium and then enters the third heat exchanger 10 through the second liquid pump 9 to apply work. 3. Switches and thermometers are arranged at each heat exchange position of the second heat exchanger 4, so as to control the temperature of the low-temperature medium flowing out of the second heat exchanger 4 by controlling the area of the medium flowing into the second heat exchanger 4, so that the low-temperature medium flowing out of the second heat exchanger 4 can be completely liquefied, thereby avoiding that the temperature of the low-temperature medium that flows out is too much lower than the liquefaction temperature and affects the energy output rate. The cycle is repeated to greatly improve the energy conversion rate.

Compared with the traditional cutting device, the device has the following advantages: the traditional ways for providing power and energy, including internal combustion engines, boilers, hydropower generation, coal-fired power generation, wind power generation and photovoltaic power generation, are fundamentally changed so that the kinetic energy provided for human beings is more environmentally friendly and pollution-free, wherein the internal combustion engines consume the non-renewable energy oil; the use of oil will greatly reduce the underground reserves of oil and pollute the environment; and the massive use of oil will cause the competition in oil resource, trigger a war and endanger human beings; the steam boilers generally consume coals during use; the use of coals will more seriously pollute the environment and consume more non-renewable energies than the use of oil; and the bulk mining of coals is easy to cause mine disasters and endanger human beings; the coal-fired power generation also consumes coals during use, thereby more seriously polluting the environment and consuming more non-renewable energies; the hydropower generation needs long construction period and more raw materials; the construction of hydropower stations is easy to destroy the original ecology and cause earthquakes; for the wind power generation and the photovoltaic power generation, the resources are unstable and highly volatile; and for the State Grid, wind electricity and photovoltaic electricity are not high-quality electricity but garbage electricity. The present invention saves a lot of precious resources, protects the environment, and reduces burdens of the whole society for energy due to energy utilization. The air energy power machine can be arranged for use anytime and anywhere. The energy of radiant air with solar energy is inexhaustible; the energy provided by the air energy power machine can become kinetic energy and electricity according to the law of energy conservation; the kinetic energy vehicle generates heat by friction between the tyres and the ground and returns the heat to the air, while the electric energy is also returned to the air after being used at the other end, so the use of air energy has no side effect.

The present invention has novel concept, ingenious structure and strong practicality, and utilizes the energy by that the work applied to the increase of air temperature is greater than the work applied to the consumption of power through air compression so that the energy utilization is cleaner.

We claim:

1. An air energy power machine, comprising an air compressor (1), wherein an air inlet end of the air compressor (1) is connected with an air storage tank (2) through a pipeline; an air outlet end of the air compressor (1) is connected with a first heat exchanger (3) through a pipeline; a second heat exchanger (4) is connected to a right side of the first heat exchanger (3) through a pipeline; and the second heat exchanger (4) is connected with the air storage tank (2) to form a closed loop;

a first liquid pump (5) connected with the first heat exchanger (3) through a pipeline is arranged below the first heat exchanger (3); a first liquid collection tank (6) is connected to the first liquid pump (5); a first steam turbine (7) is arranged above the first heat exchanger (3); a steam inlet of the first steam turbine (7) is connected with the first heat exchanger (3) through a pipeline; a steam outlet of the first steam turbine (7) is connected with the second heat exchanger (4) through a pipeline; and the second heat exchanger (4) is connected with the first liquid collection tank (6) through a pipeline to form a closed loop.

2. The air energy power machine according to claim 1, wherein a second liquid collection tank (8) is arranged below the second heat exchanger (4); a second liquid pump (9) is connected to the second liquid collection tank (8) through a pipeline; a third heat exchanger (10) is connected to the second liquid pump (9); a second steam turbine (11) is arranged above the third heat exchanger (10); a steam inlet of the second steam turbine (11) is connected with a third heat exchanger (10); a steam outlet of the second steam turbine (11) is connected with the second heat exchanger (4); and the second heat exchanger (4) is connected with the second liquid collection tank (8) through a pipeline to form a closed loop.

3. The air energy power machine according to claim 2, wherein the steam outlet of the first steam turbine (7) is connected with the third heat exchanger (10) through a pipeline; the third heat exchanger (10) is connected with the second heat exchanger (4) through a pipeline; and the second heat exchanger (4) is connected with the first liquid collection tank (6).

4. The air energy power machine according to claim 1, wherein a plurality of mutually unconnected standpipes (12) are arranged in the second heat exchanger (4).

* * * * *